United States Patent [19]

Gilardone, Jr.

[11] Patent Number: 4,654,044

[45] **Date of Patent: * Mar. 31, 1987**

[54] TRANSFER PRINTED DIRECT EMBROIDERED GARMENTS, DRAPERIES, PIECE GOODS OR THE LIKE

[75] Inventor: Joseph C. Gilardone, Jr., Virginville, Pa.

[73] Assignee: Virginville Patents, Inc., Virginville, Pa.

[ * ] Notice: The portion of the term of this patent subsequent to Mar. 27, 2001 has been disclaimed.

[21] Appl. No.: 758,171

[22] Filed: Jul. 23, 1985

[51] Int. Cl.[1] ..... D06P 1/16; D05C 17/00

[52] U.S. Cl. ..... 8/471; 8/494; 8/922; 428/187; 112/439; 112/266.1

[58] Field of Search ..... 8/471, 494

[56] References Cited

U.S. PATENT DOCUMENTS 4,103,634 8/1978 Schachter ..... 112/439

4,439,202 3/1984 Sernaker ..... 8/471

*Primary Examiner*—A. Lionel Clingman

*Attorney, Agent, or Firm*—Michael F. Petock

[57] ABSTRACT

A high quality embroidered garment, drapery, piece goods is manufactured by embroidering with embroidery thread of a single color to produce a sculptured pattern. The sculptured pattern is colored by printing from transfer paper in registry with the sculptured pattern utilizing a plurality of different colored dye stuffs.

8 Claims, 4 Drawing Figures

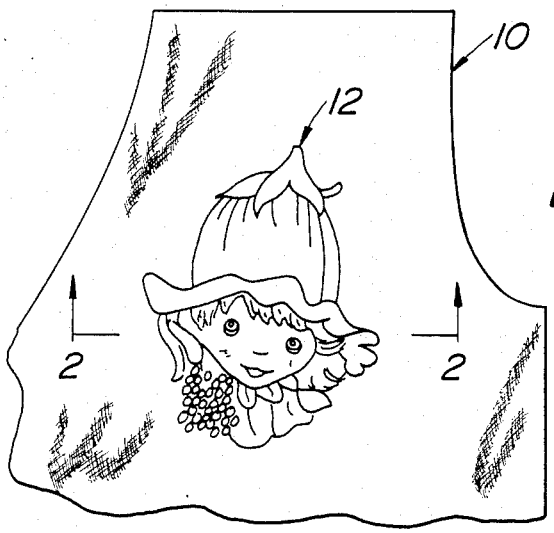
FIG. 1
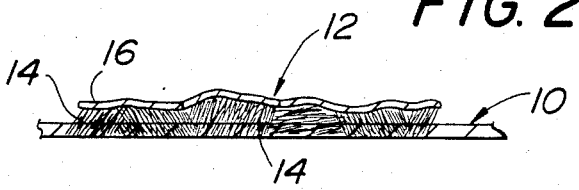
FIG. 2
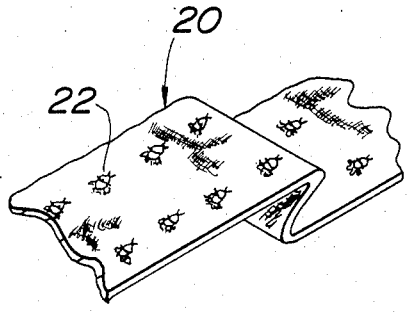
FIG. 3
FIG. 4
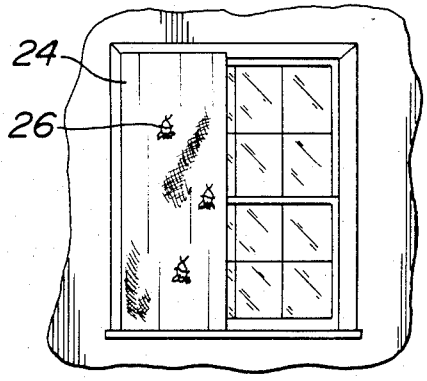

TRANSFER PRINTED DIRECT EMBROIDERED GARMENTS, DRAPERIES, PIECE GOODS OR THE LIKE

BACKGROUND OF THE INVENTION

The present invention relates to printed direct embroidered garments, draperies, piece goods or the like. More particularly, the present invention relates to the production of high quality embroidery and high quality garments, draperies, piece goods or the like.

Printing from paper onto a fabric is known. For example, the printing of a dye stuff on fabric is disclosed in U.S. Pat. No. 2,911,280. The method of making an embroidered transfer or emblem and the resulting embroidered emblem which may be adhesively mounted or sewn onto a garment is known, for example see U.S. Pat. No. 4,439,202.

SUMMARY OF THE INVENTION

Briefly and basically, in accordance with the present invention, a method of producing high quality embroidered garments, draperies or piece goods is provided. The method includes the step of embroidering a portion of a garment, drapery or the like with thread of a single color to produce a sculptured pattern. Sculptured pattern is produced by a greater or lesser thickness of embroidery threads in different portions of the pattern and embroidery threads running in different directions in different portions of the pattern. The method further includes a step of providing a transfer print on paper with a dye stuff of at least two different colors and capable of subliming under heat and pressure or vacuum. The method includes a step of registering portions of the transfer print on the paper with mating portions of the pattern and transferring color from the print on the paper as a gas to the pattern while applying sufficient heat to sublime the dye stuff.

The invention also includes the garment, drapery or piece goods as manufactured with a directly embroidered sculptured pattern on which there is subsequent printing on the sculptured embroidered pattern by printing in registry with the sculptured portions of the pattern. The invention provides the advantage of a high quality embroidered garment, drapery, piece goods or the like which is economical to manufacture, provides a very high quality of embroidered pattern and provides a garment, drapery or the like which has embroidery directly embroidered on the garment, drapery or the like, and not an emblem which is sewn to the garment or adhesively bonded to the garment.

Other advantages will appear hereinafter.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a plan view of a direct embroidered printed portion of a garment.

FIG. 2 is a cross-sectional broken away view taken along line 2—2 of FIG. 1.

FIG. 3 is a view in perspective of a piece of yard goods having thereon printed direct embroidery in accordance with the present invention.

FIG. 4 is an elevation view of a drapery having printed direct embroidery in accordance with the present invention thereon.

DETAILED DESCRIPTION OF THE PREFERRED EMBODIMENTS

Referring now to drawings in detail, wherein like numerals indicate like elements, there is shown in FIG. 1 a garment 10 or a portion of a garment on which there is directly embroidered a sculptured design 12 which has been subsequently printed. Referring to FIG. 2 taken in conjunction with FIG. 1, the design 12 is directly embroidered onto the garment 10 utilizing thread of a single color, preferably white. The entire garment may be placed in an embroidery machine, or a portion of the garment which is then sewn to other portions to make a completed garment may be placed in an embroidery machine by mounting it on a frame or jig. The embroidery machine may be a Schiffli embroidery machine or other suitable embroidery machine.

The sculptured pattern is produced on the garment 10 by producing a greater or lesser thickness of embroidery threads in different portions of the pattern design 12 and by having the embroidery threads running in different directions in different portions of the pattern. This is illustrated in FIG. 2 wherein the embroidered pattern 12 is shown to have different heights in different portions and the embroidery threads 14 run in different directions.

In practicing the invention, transfer print paper is produced, as is well known in the art, by forming dye stuff on the print paper. The print paper may be provided with two or more different colors and the dye stuff on the print paper is capable of subliming under heat and pressure or vacuum. In producing the printed direct embroidery on garment 10, the design on the print paper is registered with mating portions of the pattern. For example, the design on the print paper would be the mirror image of the design 12 shown in FIG. 1. The cap portion of the print paper would be mated with the sculptured design of the cap on design 12. Preferably, heat and pressure is provided to cause the dye stuff to sublime and transfer the color from the print paper to the embroidery threads. The embroidery threads may be of any composition that accepts the dye well, such as polyester thread. The dye stuff is transferred from the print paper to the embroidery threads as a gas. The transferred dye stuff is shown as layer 16 in FIG. 2.

Referring to FIG. 3, there is shown a section of piece goods or yard goods 20 on which there is a multitude of printed direct embroideries produced as described with respect to FIG. 1. In other words, the piece goods or yard goods is placed in an embroidery machine, and a plurality of sculptured embroidered patterns are embroidered on the piece goods (yard goods) using thread of a single color, preferably white. As stated above, the embroidery thread may be of any composition that accepts the dye well. The embroideries 22 are then printed using different color dyes registered with mating portions of the sculptured embroidered pattern, preferably utilizing transfer print paper.

The piece goods 20 may be constructed into various high quality garments and other products, including draperies as illustrated in FIG. 4.

Referring to FIG. 4 there is shown a drapery 24 having thereon a plurality of printed direct embroideries 26. The printed direct embroideries are produced as described with respect to FIG. 1.

The present invention may be embodied in other specific forms without departing from the spirit or essential attributes thereof and, accordingly, reference should be made to the appended claims, rather than to the foregoing specification as indicating the scope of the invention.

I claim:

1. A method of producing a high quality embroidered garment, draperies or piece goods, comprising:

embroidering a portion of a garment, drapery or piece goods with embroidery thread of a single color which accepts sublimation dye to produce a sculptured pattern, said sculptured pattern being produced by a greater or lesser thickness of embroidery threads in different portions of the pattern and/or embroidery threads running in different directions in different portions of the pattern;

providing a transfer print on paper with dye stuffs of at least two different colors and capable of subliming under heat and pressure or vacuum;

registering portions of the transfer print on the paper with mating portions of said pattern; and transferring color from said print on said paper by sublimation to the pattern while applying sufficient heat to sublime said dye stuff.

2. A method in accordance with claim 1 wherein said garment is a dress, blouse or the like.

3. A method in accordance with claim 1 wherein said piece goods for the manufacture of other items.

4. A method in accordance with claim 1 wherein said piece goods are structured into draperies.

5. A manufactured article comprising a pattern embroidered directly on a garment, drapery, piece goods or the like, embroidered with thread of a single color and of a composition which accepts a dye, said embroidered pattern having a sculptured effect produced by a greater thickness of embroidered pattern in one portion than in another and/or by embroidery threads running in different directions, at least two colors of dye stuff printed by a transfer printing method on the embroidery thread stitches, said colors being in registry with sculptured portions of the embroidered pattern, said colors being printed on the embroidery pattern to produce a high quality direct embroidered garment, drapery, piece goods or the like.

6. A manufactured article in accordance with claim 5 wherein said thread of a single color is white thread.

7. A method in accordance with claim 1 wherein said embroidery thread is comprised of polyester.

8. A manufactured article in accordance with claim 5 wherein said embroidery thread is comprised of polyester.

* * * * *